US007976236B2

(12) United States Patent
Oomoto

(10) Patent No.: US 7,976,236 B2
(45) Date of Patent: Jul. 12, 2011

(54) APPLICATOR

(75) Inventor: Kei Oomoto, Fujioka (JP)

(73) Assignee: Mitsubishi Pencil Company, Limited, Shinagawa-Ku, Tokyo (JP)

( * ) Notice: Subject to any disclaimer, the term of this patent is extended or adjusted under 35 U.S.C. 154(b) by 0 days.

(21) Appl. No.: 12/747,799

(22) PCT Filed: Dec. 10, 2008

(86) PCT No.: PCT/JP2008/072413

§ 371 (c)(1),
(2), (4) Date: Jun. 11, 2010

(87) PCT Pub. No.: WO2009/075292

PCT Pub. Date: Jun. 18, 2009

(65) Prior Publication Data

US 2010/0266328 A1 Oct. 21, 2010

(30) Foreign Application Priority Data

Dec. 12, 2007 (JP) ..... 2007-320990

(51) Int. Cl.
*B43K 5/00* (2006.01)

(52) U.S. Cl. ..... 401/206; 401/205

(58) Field of Classification Search ..... 401/198, 401/199, 205, 206, 263, 264
See application file for complete search history.

(56) References Cited

U.S. PATENT DOCUMENTS 5,035,524 A 7/1991 Sakurai
5,067,838 A * 11/1991 Iwase ..... 401/206

(Continued)

FOREIGN PATENT DOCUMENTS

JP 59-120184 U 8/1984

(Continued)

OTHER PUBLICATIONS

Written Opinion of the International Search Authority (Form PCT/ISA/237) dated Jan. 13, 2009 and International Preliminary Report on Patentability (Form PCT/IB/373) dated Jun. 24, 2010 in corresponding International Patent Application No. PCT/JP2008/072413, and English translations thereof.

(Continued)

*Primary Examiner* — David J Walczak
(74) *Attorney, Agent, or Firm* — Buchanan Ingersoll & Rooney PC

(57) ABSTRACT

An applicator constructed such that when the user clicks a rear end of an inner barrel, a valve mechanism is actuated by moving the inner barrel relative to an outer barrel, whereby an application liquid is supplied to an applying element arranged at a front end part of the outer barrel, and that when a valve seat member and a valve rod member move relatively to each other, the valve mechanism can take a first state in which a piston portion on the front side of the valve rod member comes into sliding contact with a front-side liquid-tight portion inside the valve seat member, a second state in which both of the piston portion on the front side of the valve rod member and piston portion on the rear side of valve rod member do not come in sliding contact with the corresponding liquid-tight portions inside the valve seat member, and a third state in which the piston portion on the rear side of the valve rod member comes into sliding contact with the rear-side liquid-tight portion.

6 Claims, 6 Drawing Sheets

U.S. PATENT DOCUMENTS

| | | | | |
|---|---|---|---|---|
| 5,615,963 | A * | 4/1997 | Kobayashi | 401/206 |
| 6,599,046 | B2 * | 7/2003 | Fukushima et al. | 401/206 |

FOREIGN PATENT DOCUMENTS

| | | | |
|---|---|---|---|
| JP | 63-060379 | U | 4/1988 |
| JP | 63-060380 | U | 4/1988 |
| JP | 63-176580 | U | 11/1988 |
| JP | 5-033872 | U | 5/1993 |

OTHER PUBLICATIONS

International Search Report dated Jan. 13, 2009.

* cited by examiner

APPLICATOR

TECHNICAL FIELD

The present invention relates to a free liquid type applicator that directly stores an application liquid such as ink, cosmetic, liquid medicine, adhesive or the like in a liquid container such as an ink tank or the like, and applies the application liquid to a target object (including writing).

BACKGROUND ART

The applicator is to apply an application liquid such as ink, cosmetic or the like that is directly stored in the liquid container, to a target object by means of an applying element.

Conventionally, as an applicator of this kind there is a configuration that includes a valve mechanism that selects whether the liquid is supplied or not supplied from the liquid storing space to the applying element by means of a valve member.

The valve mechanism of this kind functions to eject the application liquid as the valve member opens, but has the problem that the application liquid drips down from the applying element or becomes starved due to a surplus or shortage of the application liquid to be fed to the applying element depending on the length of the click operating time when the valve member is opened or the like and/or the differential pressure between the external air and the interior of the liquid container.

In the prior art example, namely the valve mechanisms disclosed in Japanese Utility Model Application Laid-open SHO 63-176580 (patent document 1) and Japanese Utility Model Application Laid-open HEI 05-33872 and its whole description (see patent document 2), the inter space of the outer sleeve is isolated by the piston portion arranged at the front end of the valve rod and the rectifying sleeve provided at a position near the rear end inside the outer sleeve so that an approximately fixed amount of fluid in the isolated inner space can be ejected when the valve is opened, whereby the amount of the fluid to be fed to the applying element is adjusted to be suitable.

Though in the above prior art, the application liquid will not be supplied excessively due to volume expansion of the air inside the storage space, air displacement performance becomes poor depending on the viscosity of the application liquid. Hence, the prior art has the problem that a fixed amount of application liquid can be fed but cannot be supplied smoothly.

Patent Document 1:

Japanese Utility Model Application Laid-open SHO 63-176580

Patent Document 2:

Japanese Utility Model Application Laid-open HEI 05-33872

DISCLOSURE OF INVENTION

Problems to be Solved by the Invention

In view of the above problems, the present invention is to provide an applicator that can eject an application liquid in an approximately constant amount without regard to the viscosity of the application liquid.

Means for Solving the Problems

The present invention relates to an applicator, which includes a valve mechanism disposed in a communication passage between a liquid storing space for storing an application liquid and an applying element, the valve mechanism being to permit and suspend a supply of the application liquid toward the applying element by moving a valve seat member and a valve rod member relatively to each other in an axial direction, wherein the valve seat member of the valve mechanism is an approximate cylinder that has openings at both ends with respect to the axial direction and is formed on an interior side thereof with liquid-tight portions in a front part and in a rear part which the valve rod member comes into sliding contact with, and is arranged so that the rear-side opening faces the liquid storing space and the front-side opening faces the applying element side;

a piston portion on a front side of the valve rod member that comes into liquid-tight contact with the front-side liquid-tight portion inside the valve seat member and a piston portion on a rear side of the valve rod member that comes into liquid-tight contact with the rear-side liquid-tight portion inside the valve seat member are provided on an outer peripheral part of the valve rod member while a space that allows the application liquid to flow is formed between the outer peripheral part and an inner wall of valve seat member; and, a distance between the piston portion on the front side of the valve rod member and the piston portion on the rear side of the valve rod member is set to be shorter than a distance between the front-side liquid-tight portion and the rear-side liquid-tight portion inside the valve seat member, and when the valve seat member and valve rod member move relatively to each other, the valve mechanism can take a first state in which the piston portion on the front side of the valve rod member comes into sliding contact with the front-side liquid-tight portion inside the valve seat member, a second state in which both of the piston portion on the front side of the valve rod member and the piston portion on the rear side do not come in sliding contact with the corresponding liquid-tight portions inside the valve seat member, and a third state in which the piston portion on the rear side of the valve rod member comes into sliding contact with the rear-side liquid-tight portion inside the valve seat member.

in the present invention, it is preferable that, in the first state, when the valve rod member has moved rearward with respect to the valve seat member by a distance less than a first distance from a front side end position, the piston portion on the front side of the valve rod member slides as being in close contact with the front-side liquid-tight portion of the valve seat member, and the piston portion on the rear side of the valve rod member is located away from the rear-side liquid-tight portion of the valve seat member so that the liquid storing space side is pressurized;

in the second state, when the valve rod member has moved rearward with respect to the valve seat member by a distance equal to or greater than the first distance and less than a second distance, the piston portion on the front side of the valve rod member separates from the front-side liquid-tight portion of the valve seat member, and the piston portion on the rear side of the valve rod member is located away from the rear-side liquid-tight portion of the valve seat member so that the front-side opening and rear-side opening are made to communicate through an interior of the valve seat member;

in the third state, when the valve rod member has moved rearward with respect to the valve seat member by a distance equal to or greater than the second distance, the piston portion on the front side of the valve rod member is located away from the front-side liquid-tight portion of the valve seat member and the piston portion on the rear side of the valve rod member slides being in close contact with the rear-side liquid-tight portion of the valve seal member so as to lead the application liquid to the applying element; and, when the valve rod member and the valve seat member move relatively to each other in the axial direction, the distance creating the second state is smaller than the distances creating the first state and the third state, and functions to be the distance at which a pressure inside the liquid storing space is released to an outside without causing blobbing of the application liquid.

Also, in the present invention, it is preferable that the valve mechanism of the applicator has a spring element inserted between the valve seat member and the valve rod member and the spring element urges the valve rod member so that the valve rod member is positioned at the front end portion with respect to the valve seat member.

Further, in the present invention, it is preferable that a pipe passage that communicates the front-side opening to the applying element is arranged at the front-side opening of the valve seat member, and a leading rod element for leading the application liquid toward the applying element is inserted inside the pipe passage.

Also, in the present invention, it is preferable that a clearance between the leading rod element and an interior wall of the pipe passage is sized so as to lead the application liquid.

It is also preferable in the present invention that the leading rod element uses a material that presents excellent wettability with the application liquid.

Advantages of the Invention

According to the applicators defined in Claims 1 to 6 of the present invention, in the valve mechanism, the distance between the piston portion on the front side of the valve rod member and the piston portion on the rear side of the valve rod member is set to be shorter than the distance between the front-side liquid-tight portion and the rear-side liquid-tight portion inside the valve seat member, and when the valve seat member and the valve rod member move relatively to each other, the valve mechanism can take the first state in which the piston portion on the front side of the valve rod member comes into sliding contact with the front-side liquid-tight portion inside the valve seat member, the second state in which both of the piston portion on the front side of the valve rod member and the piston portion on the rear side of the valve rod member do not come in sliding contact with the corresponding liquid-tight portions inside the valve seat member, and the third state in which the piston portion on the rear side of the valve rod member comes into sliding contact with the rear-side liquid-tight portion inside the valve seat member. Accordingly, when the valve seat member and the valve rod member move relatively to each other in the axial direction by operating the valve mechanism with the front side downward, in the first state the application liquid flows into the space defined by the interior wall of the valve seat with the applying element side closed by the piston portion on the front side, in the second state the liquid storing space is connected with the atmospheric air through the space defined by the valve seat interior wall and the applying element, and then, in the third state the liquid storing space side is closed by the piston portion on the rear side so that the application liquid in the valve seat interior wall flows to the applying element, thus forming a mechanism for a pumping operation.

Accordingly, since, by operating the valve mechanism, the liquid storing space is pressurized in the first state, the pressure in the liquid storing space is released in the second state, then the applying element liquid is flowed out to the applying element in the third state, a markedly good air displacement performance can be achieved.

As a result, even if the air etc. inside the liquid storing space has expanded in volume due to a temperature rise or the like, and if the pressure in the liquid storing space has become too high, no blobbing will occur due to accidental ejection of the application liquid.

Here, in the case where the valve mechanism of the applicator has a spring element inserted between the valve seat member and the valve rod member and the spring element is adapted to urge the valve rod member so that the valve rod member is positioned at the front end position with respect to the valve seat member, when the applicator has taken the third state from the first state via the second state by pressing the applicator and then the pressing force is released, the applicator returns to the first state from the third state via the second state, adding easiness to use.

Further, when the pipe passage that communicates the front-side opening with the applying element is arranged at the front-side opening of the valve seat member and the leading rod element for leading the application liquid toward the applying element is inserted inside the pipe passage, it is possible to smoothly convey the application liquid to the applying element by the leading rod element.

Also, sizing the clearance between the leading rod element and the interior wall of the pipe passage so as to lead the application liquid, makes it possible to lead the application liquid further smoothly.

Also, when the leading rod element uses a material that presents excellent wettability with the application liquid, it is possible to lead the application liquid more smoothly.

DESCRIPTION OF REFERENCE NUMERALS

Figure 1:
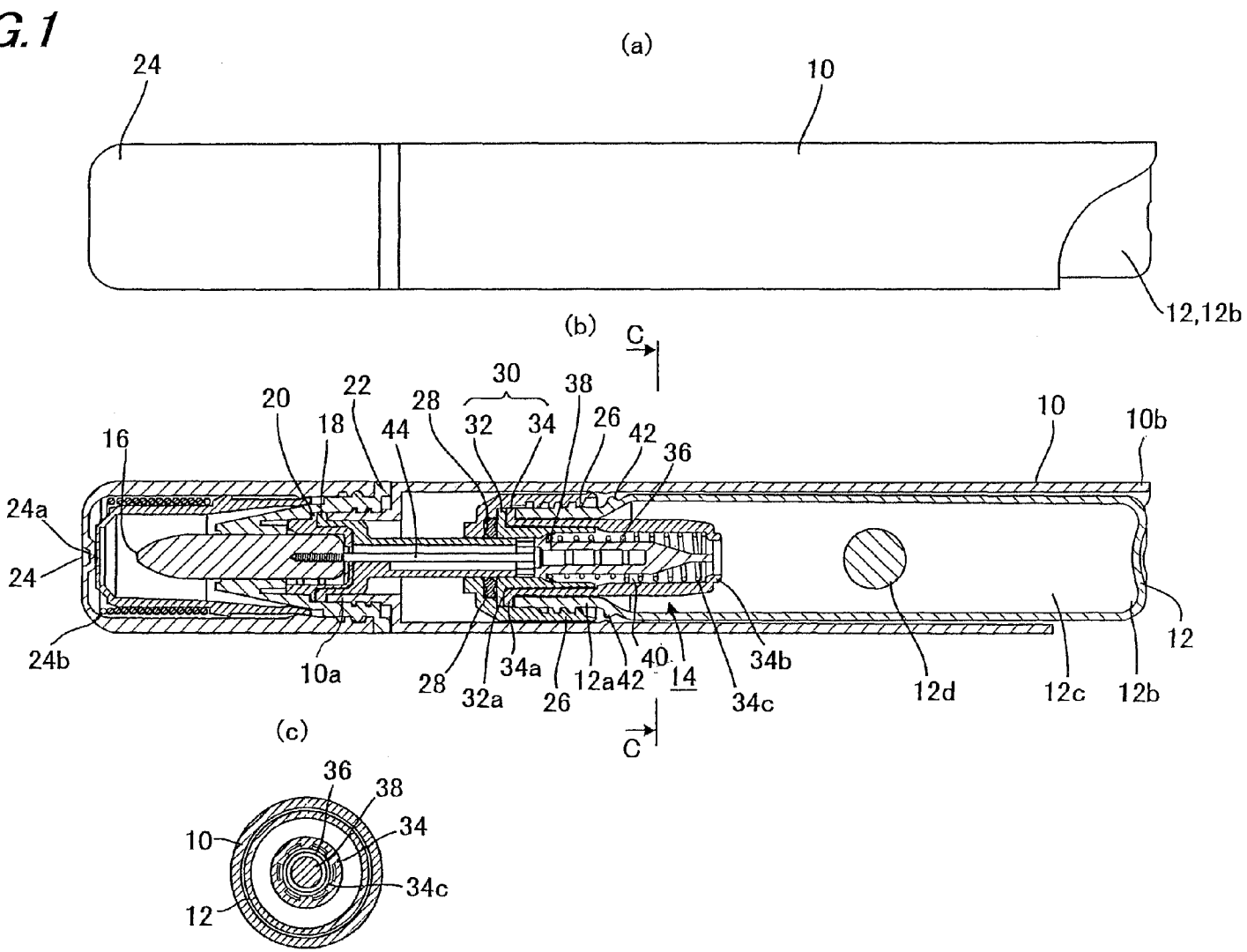
[FIGS. 1](*a*), (*b*) and (*c*) are an appearance view, vertical sectional view, and cross sectional view cut along a line C-C, of an applicator according to the embodiment.

10 outer barrel
10*a* outer barrel front end part
10*b* outer barrel rear end
12 inner barrel
12*a* inner barrel front end part

12*b* inner barrel rear end
12*c* liquid storing space
12*d* agitation ball
14 valve mechanism
16 applying element
18 ink conducting pipe
18*a* ink conducting pipe front end part
18*b* ink conducting pipe rear end part
20 seal ring
22 front barrel
24 cap
24*a* inner cap
24*b* in-cap spring
26 inner front barrel
28 packing
30 valve seat member
32 front valve element
32*a* front valve element flange
32*b* front-side liquid-tight portion
34 rear valve element
34*a* rear valve element flange
34*b* rear-side liquid-tight portion
34*c* guide column
36 spring element
38 valve rod member
38*a* piston portion on the front side
38*b* piston portion on the rear side
40 space
42 annular projection
44 leading rod element
46 rib

BEST MODE FOR CARRYING OUT THE INVENTION

Next, the embodiment of the present invention will be described with reference to the accompanying drawings.

Figure 2:
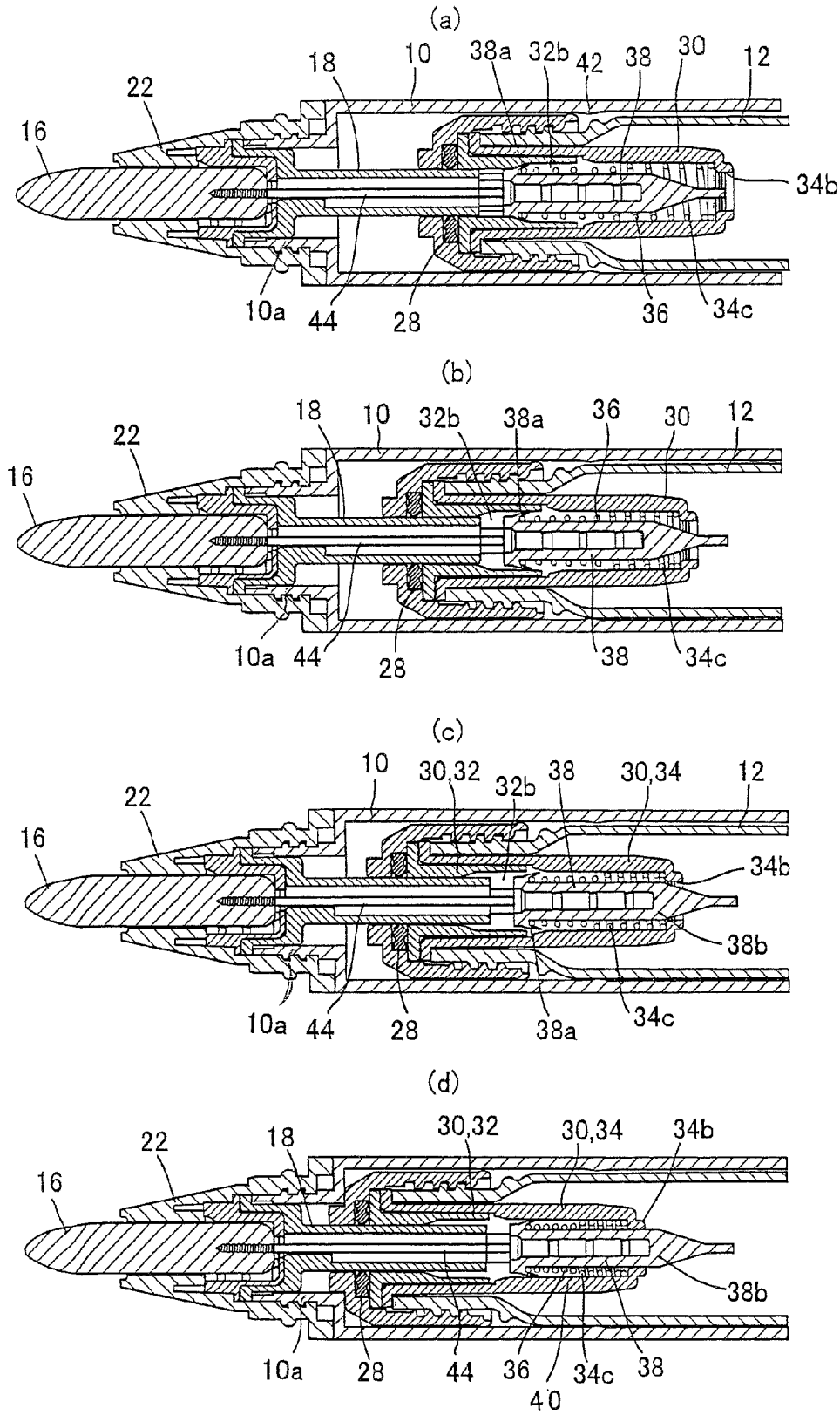
[FIGS. 2](*a*) to (*d*) are diagrams illustrating operational steps of a valve mechanism of the applicator in FIG. 1.
Figure 3:
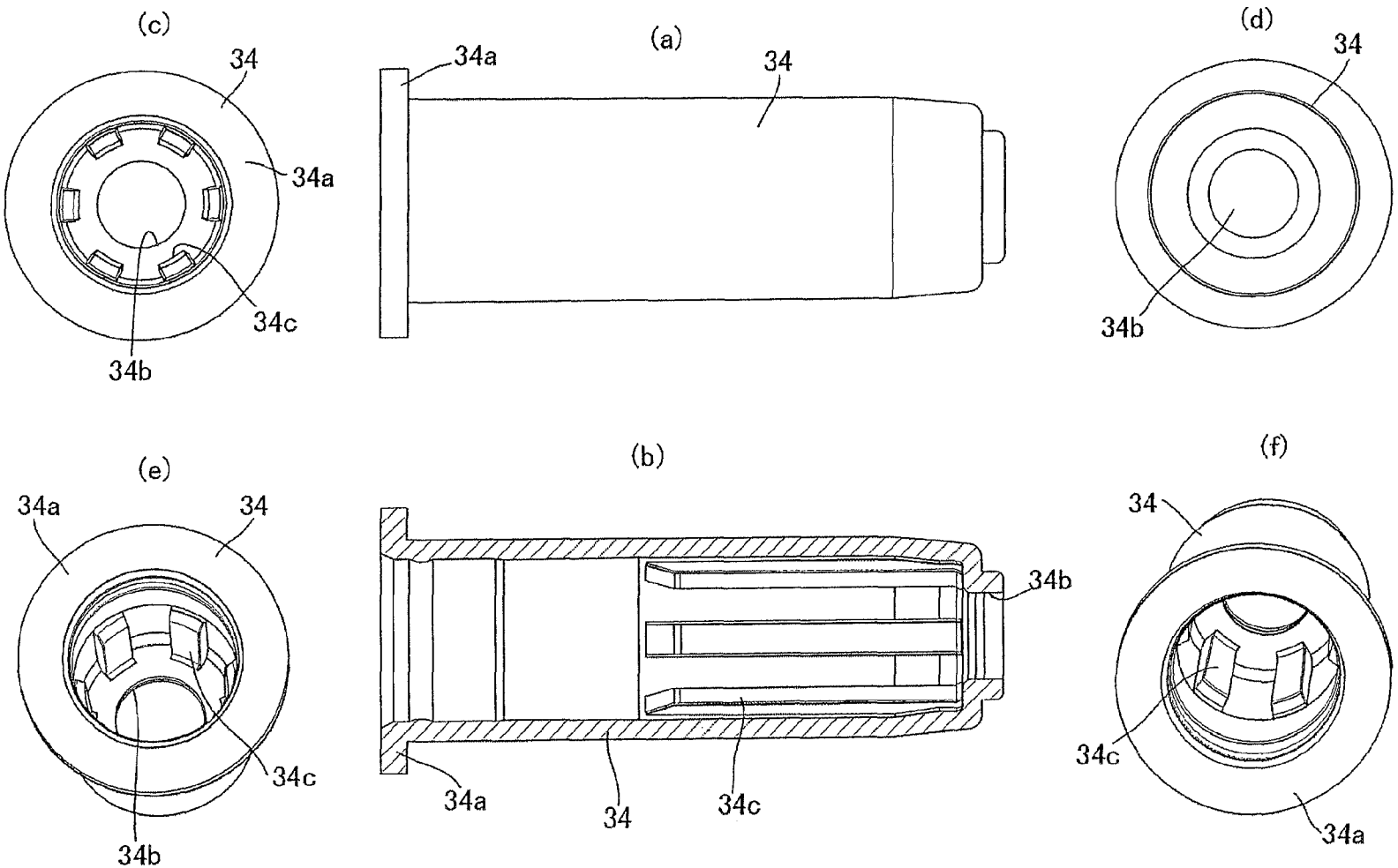
[FIG. 3 ] is an illustrative diagram of a rear valve element of a valve seat member in the valve mechanism of the applicator of FIG. 1, (*a*) an appearance view, (*b*) a vertical sectional view, (*c*) a front view, (*d*) a rear-side view, (*e*) a front perspective with the subject inclined upward, and (*f*) a front perspective view with the subject inclined downward.
Figure 4:
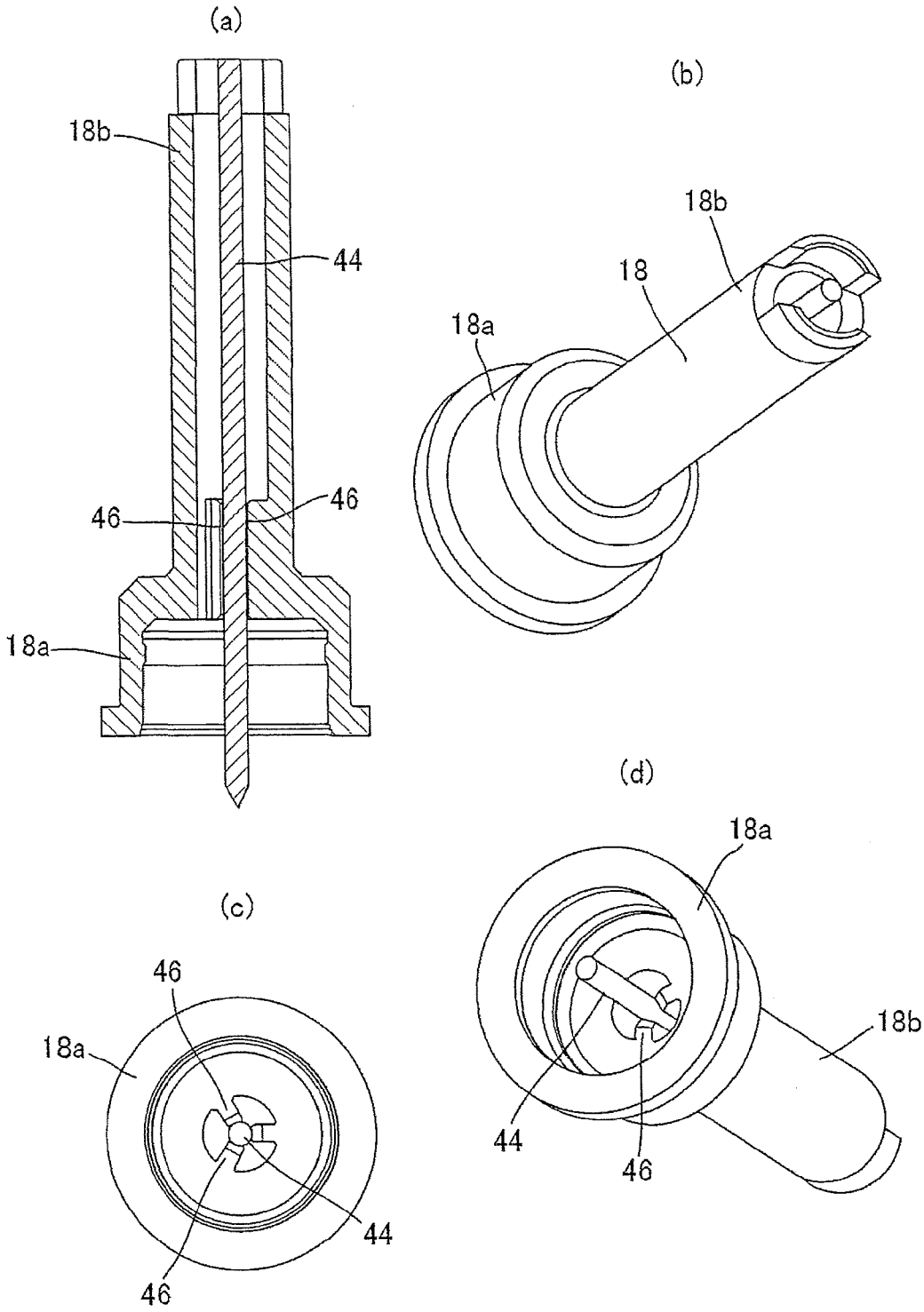
[FIG. 4](*a*) to (*d*) are a sectional illustrative view, rear perspective view, front view and front perspective view, of a pipe passage and a leading rod element connected to the applicator according to the embodiment.
Figure 5:
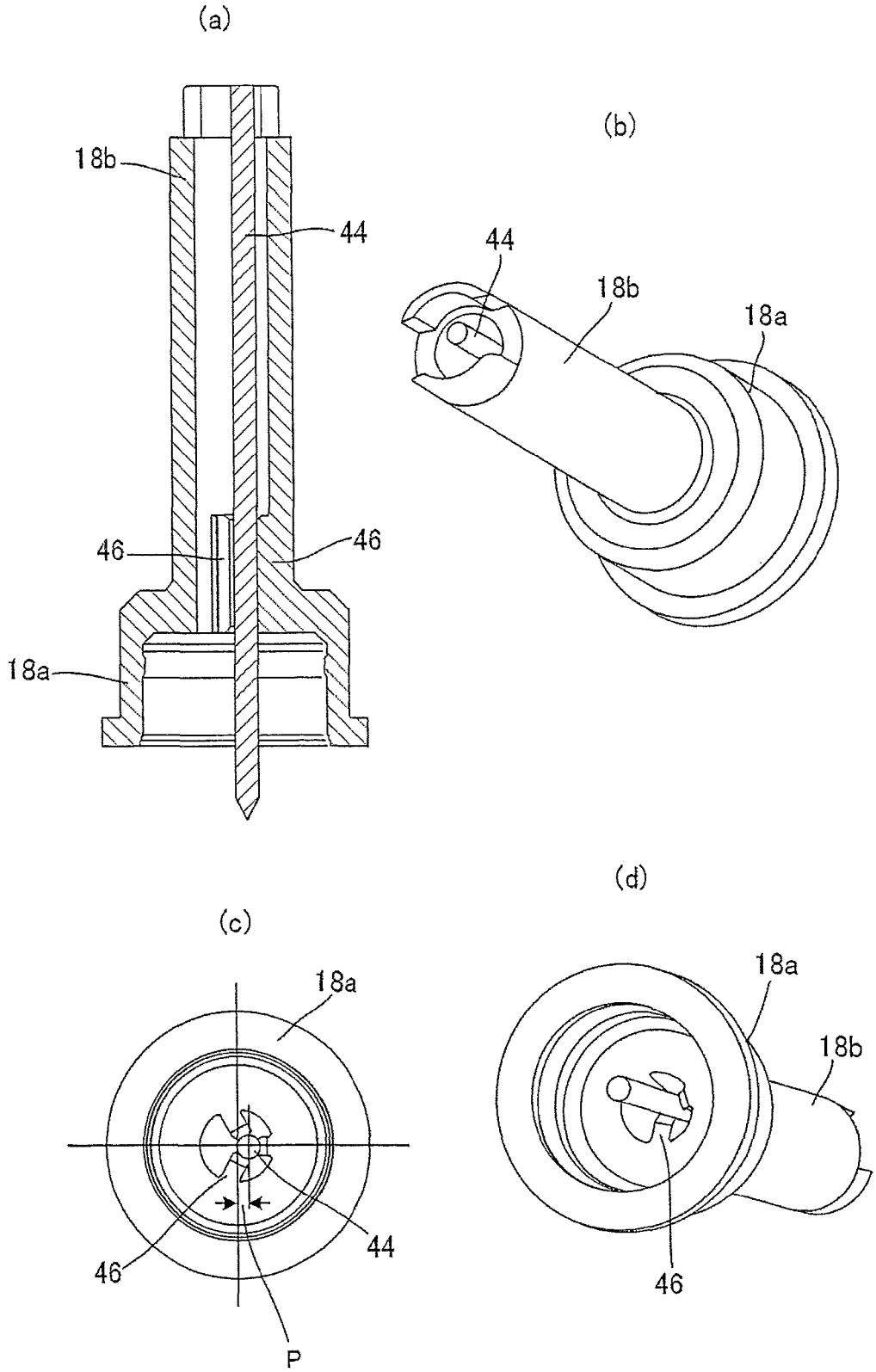
[FIGS. 5](*a*) to (*d*) are a sectional illustrative view, rear perspective view, front view and front perspective view, of a pipe passage and a leading rod element connected to the applicator according to a variational example 1 of the embodiment.
Figure 6:
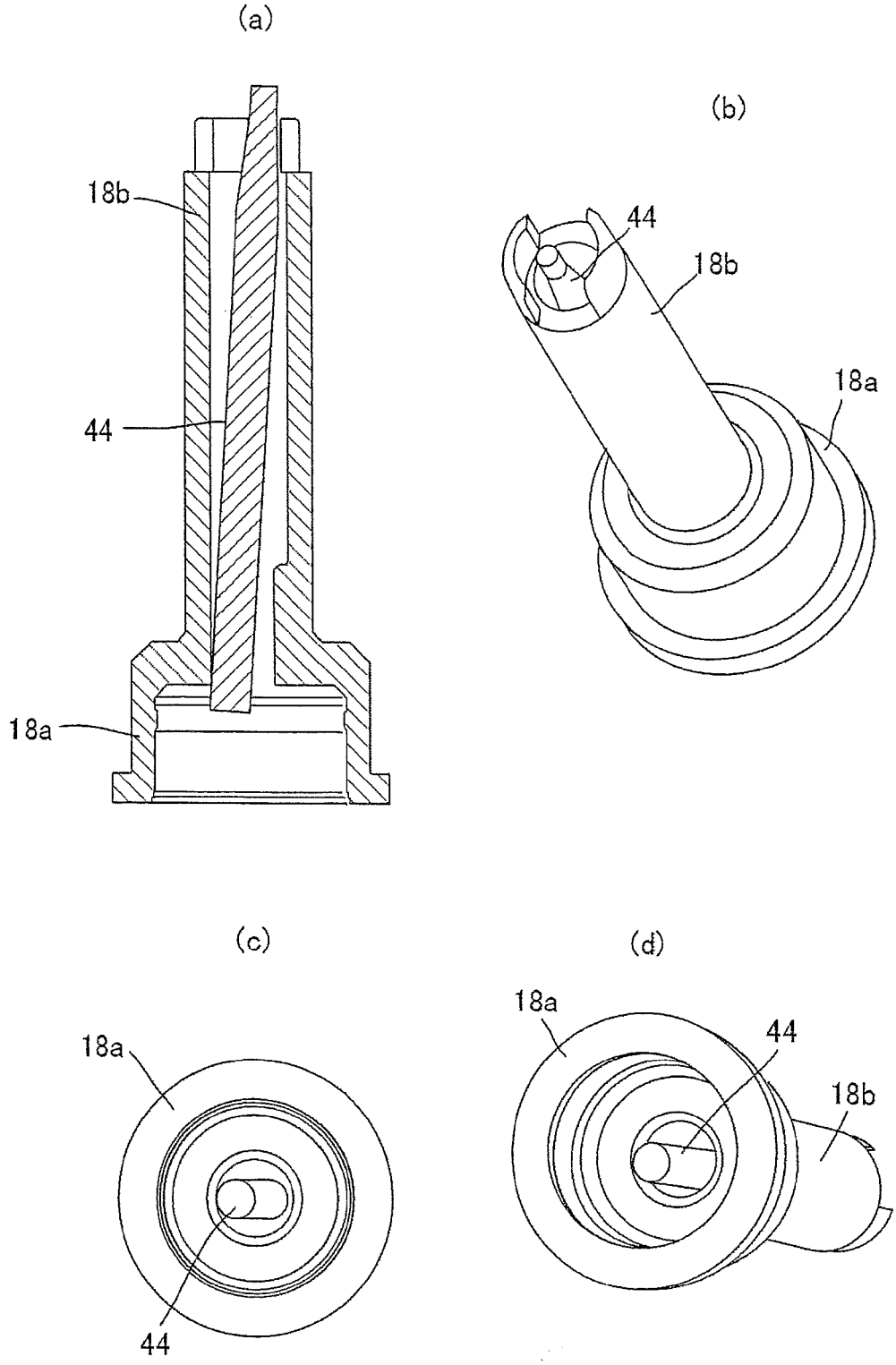
[FIGS. 6](*a*) to (*d*) are a sectional illustrative view, rear perspective view, front view and front perspective view, of a pipe passage and leading rod element connected to the applicator according to a variational example 2.

FIGS. 1 to 6 are illustrative diagrams showing one exemplary embodiment of the invention. FIGS. 1(*a*), (*b*) and (*c*) are an appearance view, vertical sectional view, and cross sectional view cut along a line C-C, of an applicator according to the embodiment. FIGS. 2(*a*) to (*d*) are diagrams illustrating operational steps of a valve mechanism of an applicator. FIG. 3 is an illustrative diagram of a rear valve element of a valve seat member in the valve mechanism of the applicator of FIG. 1, (*a*) an appearance view, (*b*) a vertical sectional view, (*c*) a front view, (*d*) a rear view, (*e*) a front perspective view with the subject inclined upward, and (*f*) a front perspective view with the subject inclined downward. FIGS. 4(*a*) to (*d*) are a sectional illustrative view, rear perspective view, front view, and front perspective view, of a pipe passage and a leading rod element connected to the applicator according to the embodiment. FIGS. 5(*a*) to (*d*) are a sectional illustrative view, rear perspective view, front view and front perspective view, of a pipe passage and a leading rod element connected to the applicator according to a variational example 1 of the embodiment. FIGS. 6(*a*) to (*d*) are a sectional illustrative view, rear perspective view, front view and front perspective view, of a pipe passage and leading rod element connected to the applicator according to a variational example 2.

In the applicator of the embodiment, a tank-like inner barrel 12 is disposed so as to move forward and backward inside an approximately cylindrical outer barrel 10 that is opened at a rear end 10*b*. As the user clicks a rear end 12*b* of inner barrel 12, the inner barrel moves forward relative to outer barrel 10 so as to actuate an aftermentioned valve mechanism 14, whereby an application liquid is supplied to an applying element 16 arranged at a front end part 10*a* of outer barrel 10.

Front end part 10*a* of outer barrel 10 is formed stepwise so as to have a reduced diameter. Abutted on the front face of the front end part 10*a* is a rim (projected like a flange) of a cup-shaped front end part 18*a* of an ink conducting pipe (pipe passage flowing the application liquid from valve mechanism 14 toward applying element 16) 18. Inserted into front end part 18*a* of the ink conducting pipe 18 is the rear end of applying element 16 with a seal ring 20 disposed in-between. Applying element 16, seal ring 20 and front end part 18*a* of the ink conducting pipe are fixed to outer barrel 10 by externally fitting a front barrel 22 on the outer barrel front end part 10*a* in a state that the hollowing portion of the hollow cylindrical front barrel 22 that tapers to the forward end, is enclosing the portion behind the middle part of the applying element 16, seal ring 20 and front end part 18*a* of the ink conducting pipe 18. Further, a cap 24 that covers and protects applying element 16 is removably fitted on outer barrel front end, part 10*a*. The cap 24 has an inner cap 24*a* therein that is urged against front barrel 22 by a spring 24*b*.

The inner barrel 12 is enclosed at rear end 12*b* forming a liquid storing space 12*c* for accommodating application liquid therein (which may also accommodate an agitation ball 12*d*) and incorporates the aforementioned valve mechanism 14 in the front end part (the front end part of the inner barrel) 12*a*, which is fixed by an inner front barrel 26. Detailedly, in a state that valve mechanism 14 is fitted in the front end part 12*a* that is the narrowed part on the front side of inner barrel 12, rear end part 18*b* of ink conducting pipe 18 is slidably connected to valve mechanism 14, and inner front barrel 26 is fixed to inner barrel front end part 12*a* by screw fitting or the like with a packing 28 inserted at the front end of valve mechanism 14.

Here, the valve mechanism 14 is disposed on the communication passage between the liquid storing space 12*c* for storing the application liquid and applying element 16 to permit and suspend a supply of the application liquid toward applying element 16 by moving a valve seat member 30 and a valve, rod member 38 relatively to each other in the axial direction.

Valve seat element 30 of valve mechanism 14 is an approximate cylinder that has openings at both ends with respect to an axial direction and is formed on the interior side thereof with liquid-tight portions in the front side (front-side valve element 32) and in the rear side (rear-side valve element 34) which valve rod member 38 comes into sliding contact with, and is arranged so that the aforementioned rear-side opening faces liquid storing space 12*c* and the front-side opening faces the applying element 16 side.

Further, as shown in FIGS. 1 and 3, rib-like guide columns 34*c* for guiding valve rod member 38 are formed from the approximate center to the rear in the longitudinal direction and projected radially inwards on the interior wall of rear valve element 34 of valve seat member 30. This guide column 34*c* can prevent valve rod member 38 from skewing, climbing over the end face of front valve element 32 and causing clicking failure due to an impact when outer barrel 10 being dropped.

Specifically, front valve element 32 on the whole has an approximately cylindrical configuration having a flange 32*a* radially projected at the front end and having a greater inside diameter in the rear inner peripheral wall than that in the front inner peripheral wall. This rear inner peripheral wall corresponds to a front-side liquid-tight portion 32*b*. Rear valve piece 34 also has an approximately cylindrical configuration having a flange 34*a* radially projected at the front end and having an opening at the rear end that is reduced step-wise in diameter. This inner peripheral wall in this reduced-diametric portion corresponds to a rear-side liquid-tight portion 34*b*. Front valve piece 32 is concentrically inserted into rear valve element 34 from the front side so that flanges 32*a* and 34*a* are laid over and after packing 28 is put on the front side, inner front barrel 26 covers over these and is fixed by screw-fitting to inner barrel front end part 12*a*. In this arrangement, the front side of the reduced-diametric portion at the rear end of rear valve element 34 forms the portion for receiving an aftermentioned spring element 36.

The aforementioned valve rod member 38 is accommodated so as to be movable forward and backward inside the hollow defined by the front valve element 32 and rear valve element 34.

Provided on the outer periphery of valve rod member 38 are a front-side piston portion 38*a* that comes into liquid-tight contact with front-side liquid-tight portion 32*b* of front valve element 32 inside the aforementioned valve seat member 30, and a rear-side piston portion 38*b* that comes into liquid-tight contact with rear-side liquid-tight portion 34*b* of rear valve element 34 inside the valve seat member 30 while a space 40 that allows the application liquid to flow is formed between the outer peripheral side at the approximately middle part of the valve rod member 38 and the interior wall of valve seat member 30. Specifically, the piston portion 38*a* on the front side of valve rod member 38 is formed as an enlarged-diametric umbrella-like flexible flange. On the other hand, the piston portion 38*b* on the rear side is formed as a rearward tapering form having a smooth outer peripheral surface and functions so that when valve rod member 38 moves rearward, the small-diametric rear end passes through the opening of rear valve element 34 and then the large-diametric middle portion closely fits and slidingly contacts with rear-side liquid-tight portion 34*b* of rear valve element 34.

As described above, valve mechanism 14 has a spring element 36 inserted between valve seat member 30 and valve rod member 38. The spring element 36 abuts and urges piston portion 38*a* on the front side of valve rod member 38 from the rear side thereof so that the piston is positioned at the forward end with respect to valve seat member 30. Accordingly, if no pressing force by clicking the rear end of inner barrel 12 is applied, the piston portion 38*a* on the front side is positioned by spring element 36 so as to be in contact with the front end of front-side liquid-tight portion 32*b*, as shown in FIG. 1. Here, inner front barrel 26 abuts an annular projection 42 on the interior side of outer barrel 10 so as to prevent inner barrel 12 from moving further rearwards and falling off.

Inserted into the front-side opening (front-end opening of front valve element 32) of valve seat member 30 is the rear end part 18*b* of ink conducting pipe (pipe passage) 18 that connects this front-side opening to applying element 16. Inserted into this ink conducting pipe 18 is a leading rod element 44 for leading the application liquid toward applying element 16.

The clearance between leading rod element 44 and the interior wall of ink conducting pipe 18 is sized so as to lead the application liquid. As for the positional relationship of leading rod element 44 to ink conducting pipe 18, in the embodiment, as shown in FIG. 4, a plurality of projected ribs 46 formed inside of conducting pipe 18 on the front end part 18*a* side support leading rod element 44 so as to position leading rod element 44 at the radial center of ink conducting pipe 18 and eliminate backlash of the leading rod element in the radial direction. Further, the front end of leading rod element 44 is inserted into the rear part of applying element 16.

As for the configurations of leading rod element 44 and ink conducting pipe 18 other than that shown in FIG. 4, leading rod element 44 may be supported by ribs 46 so as to be positioned (a sifted distance p) off the radial center of ink conducting pipe 18, as in a variational example 1 shown in FIG. 5. Depending on the way of off-centering, it is possible to assist leading rod element 44 in leading of the application liquid by making leading rod element 44 closer to the interior wall of ink conducting pipe 18.

Further, as in a variational example 2 shown in FIG. 6, it is also possible to provide a configuration in which no rib 46 is formed so that leading rod element 44 can be freely positioned off the radial center of ink conducting pipe 18. Since leading rod element 44 can take a position and inclination freely within the bore of ink conducting pipe 18, it is possible to suitably promote the lead of the application liquid by making leading rod element 44 closer to, or bringing it away from, the interior wall of ink conducting pipe 18 as the applicator is shaken or moved in other ways.

As for the material for each part of the applicator, applying element 16 may use acryl, polyester and polyacetal (POM); the inner barrel and outer barrel 10 may use polypropylene (PP), polybutylene naphthalate (PBT), nylon (PA) and polyacrylonitrile (PAN); front barrel 22, cap 24, inner cap 24*a* and inner front barrel 26 may use polybutylene terephthalate (PBT), poly propylene (PP), nylon (PA) and polyacrylonitrile (PAN); packing 28 may use EPDM, silicone, NBR, IIR and fluorine; the seal ring may use low-density polyethylene (LDPE, LLDPE), high-densitypolyethylene (HDPE) and polypropylene (PP), front valve element 32 and rear valve element 34 of valve seat member 30 and valve rod member 38 may use high-density polyethylene (HDPE), low-density polyethylene (LDPE, LLDPE) and polypropylene (PP); and spring 24*b* of cap 24 and spring element 36 may use stainless steel (SUS).

It is preferred that leading rod element 44 uses a material that presents excellent wettability with the application liquid, for example, metal such as stainless steel etc., resin such as polyacetal (POM) etc., fiber bundle cores of polyester, acryl or the like, or synthesized resin mold cores of a sinter, polyacetal (POM) and the like having a liquid passage in the axial direction.

Next, valve mechanism 14 of the applicator of the embodiment will be further described in detail.

In valve mechanism 14, the distance between piston portion 38*a* on the front side and piston portion 38*b* on the rear side of valve rod member 38 is set to be shorter than the distance between the front-side liquid-tight portion 32*b* and rear-side liquid-tight portion 34*b* inside the valve seat member 30. That is, the valve mechanism is constructed such as, when valve rod member 38 and valve seat member 30 move relatively to each other in the axial direction, to take the first state in which piston portion 38*a* on the front side of valve rod member 38 comes into sliding contact with the front-side liquid-tight portion 32*b* inside the valve seat member 30, the second state in which both of the piston portion 38*a* on the front side of valve rod member 38 and the piston portion 38*b* on the rear side of valve rod member 38 do not come in sliding contact with the corresponding liquid-tight portion inside the valve seat member 30, and the third state in which piston portion 38*b* on the rear side of valve rod member 38 comes into sliding contact with the rear-side liquid-tight portion 34*b* inside the valve seat member 30.

The operation of valve mechanism 14 will be described with reference to FIG. 2.

In the ordinary state (during non-clicking) where the user does not click inner barrel rear end 12*b*, spring element 36 abuts and urges piston portion 38*a* on the front side of valve rod member 38 from the rear side thereof so that the piston is positioned at the forward end with respect to valve seat member 30, as shown in FIG. 2(*a*).

In the state where inner barrel rear end 12*b* has started to be clicked, the valve rod member 38 first takes the aforementioned first state shown in FIG. 2(*b*) where the valve rod member 38 has moved rearwards with respect to valve seat member 30 by a distance less than a first distance from the front side end position. The piston portion 38*a* on the front side of valve rod member 38 slides as being in close contact with front-side liquid-tight portion 32*b* of valve seat member 30 and the piston portion 38*b* on the rear side of valve rod member 38 is located away from rear-side liquid-tight portion 34*b* of valve seat member 30 so that the liquid storing space 12*c* side is pressurized. In this while, since piston 38*a* on the front side of valve rod member 38 slides as being in close contact with front-side liquid-tight portion 32*b* of valve seat member 30 though piston portion 38*b* on the rear side of valve rod member 38 is located away from rear-side liquid-tight portion 34*b* of valve seat member 30, the application liquid will not rush out even if the internal pressure in liquid storing space 12*c* rises.

Further, in the state where inner barrel rear end 12*b* has been further clicked, the valve rod member 38 takes the aforementioned second state shown in FIG. 2(*c*) where the valve rod member 38 has moved rearwards with respect to valve seat member 30 by a distance equal to or greater than the aforementioned first distance and less than a second distance. The piston portion 38*a* on the front side of valve rod member 38 separates from front-side liquid-tight portion 32*b* of valve seat member 30. At this moment, the piston portion 38*b* on the rear side of valve rod member 38 is located away from rear-side liquid-tight portion 34*b* of valve seat member 30, so that the front-side opening and rear-side opening are made to communicate through the interior of valve seat member 30. In this way, the interior space is put in communication with the atmosphere so that the application liquid is going to flow out to the applying element side if the inner pressure is elevated. However, this condition occurs only for an instant in the clicking operation, hence the application liquid will not rush out. Also, air displacement of liquid storing space 12*c* is improved. Also, the application liquid flows out to the applying element 16 side along leading rod element 44.

In the state where inner barrel rear end 12*b* has been kept being clicked, the valve rod member 38 takes the aforementioned third state shown in FIG. 2(*d*) where the valve rod member 38 has moved rearwards with respect to valve seat member 30 by a distance equal to or greater than the aforementioned second distance. The piston portion 38*a* on the front side of valve rod member 38 separates from front-side liquid-tight portion 32*b* of valve seat member 30 and piston portion 38*b* on the rear side of valve rod member 38 slides as being in close contact with rear light-liquid portion 34*b* of valve seal element 30 so as to lead the application liquid to applying element 16. In this case, the space 40 in which the application liquid passes is completely isolated from the liquid storing space, so that the application liquid pooled in valve mechanism 14 is smoothly conveyed through ink conducting pipe 18 to the applying element 16 side.

In this case, when valve rod member 38 and valve seat member 30 move relatively to each other in the axial direction, the distance creating the aforementioned second state is quite smaller than the distances creating the first state and the third state, and functions to be the distance (the distance that is instantly passed through) at which the pressure inside liquid storing space 12*c* is released to the outside without causing blobbing of the application liquid. When valve seat member 30 and valve rod member 38 are moved relatively to each other by operating valve mechanism 14 with the front side set downward, in the first state the application liquid flows into the space that is defined by the valve seat interior wall and closed on the applying element 16 side by the piston portion 38*a* on the front side; in the second state the liquid storing space 12*c* is connected with the atmospheric air through the space defined by the valve seat interior wall and applying element 16; and then, in the third state the liquid storing space 12*c* side is closed by the piston portion 38*b* on the rear side so that the application liquid in the valve seat interior wall flows to applying element 16, thus forming a mechanism for a pumping operation.

Accordingly, since, by operating valve mechanism 14, the liquid storing space 12*c* is pressurized in the first state, the pressure in the liquid storing space 12*c* is released in the second state, then the applying element 16 liquid is flowed out to applying element 16 in the third state, a markedly good air displacement performance can be achieved.

As a result, even if the air etc. inside liquid storing space 12*c* has expanded in volume due to a temperature rise or the like, and if the pressure in liquid storing space 12*c* has become too high, no blobbing will occur due to accidental ejection of the application liquid.

INDUSTRIAL APPLICABILITY

The applicator of the present invention can be adopted as an applicator, such as a free liquid typewriting instrument, cosmetic product, medical applicator, adhesive applicator and the like, that directly stores an application liquid such as ink, cosmetic, liquid medicine, adhesive or the like in a liquid container such as an ink tank or the like, and applies the application liquid to a target object.

The invention claimed is:

1. An applicator including a valve mechanism disposed in a communication passage between a liquid storing space for storing an application liquid and an applying element, the valve mechanism being to permit and suspend a supply of the application liquid toward the applying element by moving a valve seat member and a valve rod member relatively to each other in an axial direction, wherein the valve seat member of the valve mechanism is an approximate cylinder that has openings at both ends with respect to the axial direction is formed on an interior side thereof with liquid-tight portions in a front part and in a rear part which the valve rod member comes into sliding contact with, and is arranged so that the rear-side opening faces the liquid storing space and the front-side opening faces an applying element side;

a piston portion on a front side of the valve rod member that comes into liquid-tight contact with the front-side liquid-tight portion inside the valve seat member and a piston portion on a rear side of the valve rod member that comes into liquid-tight contact with the rear-side liquid-tight portion inside the valve seat member are provided on an outer peripheral part of the valve rod member while a space that allows the application liquid to flow is formed between the outer peripheral part and an inner wall of valve seat member; and, an distance between the piston portion on the front side of the valve rod member and the piston portion on the rear side of the valve rod member is set to be shorter than a distance between the front-side liquid-tight portion and the rear-side liquid-tight portion inside the valve seat member, and when the valve seat member and valve rod member move relatively to each other, the valve mechanism can take a first state in which the piston portion on the front side of the valve rod member comes into sliding contact with the front-side liquid-tight portion inside the valve seat member, a second state in which the piston portion on the front side of the valve rod member and the piston portion on rear side of the valve rod member do not come in sliding contact with the corresponding liquid-tight portions inside the valve seat member, and a third state in which the piston portion on the rear side of the valve rod member comes into sliding contact with the rear-side liquid-tight portion inside the valve seat member.

2. The applicator according to claim 1, wherein, in the first state, when the valve rod member has moved rearward with respect to the valve seat member by a distance less than a first distance from a front side end position, the piston portion on the front side of the valve rod member slides as being in close contact with the front-side liquid-tight portion of the seat valve member, and the piston portion on the rear side of the valve rod member is located away from the rear-side liquid-tight portion of the valve seat member so that the liquid storing space side is pressurized;

in the second state, when the valve rod member has moved rearward with respect to the valve seat member by a distance equal to or greater than the first distance and less than a second distance, the piston portion on the front side of the valve rod member separates from the front-side liquid-tight portion of the valve seat member, and the piston portion on the rear side of the valve rod member is located away from the rear-side liquid-tight portion of the valve seat member so that the front-side opening and rear-side opening are made to communicate through an interior of the valve seat member;

in the third state, when the valve rod member has moved rearward with respect to the valve seat member by a distance equal to or greater than the second distance, the piston portion on the front side of the valve rod member is located away from the front-side liquid-tight portion of the valve seat member and the piston portion on the rear side of the valve rod member slides being in close contact with the rear-side liquid-tight portion of the valve seal member so as to lead the application liquid to the applying element; and, when the valve rod member and the valve seat member move relatively to each other in the axial direction, the distance creating the second state is smaller than the distances creating the first state and the third state, and functions to be the distance at which a pressure inside the liquid storing space is released to an outside without causing blobbing of the application liquid.

3. The applicator according to claim 1, wherein the valve mechanism of the applicator has a spring element inserted between the valve seat member and the valve rod member and the spring element urges the valve rod member so that the valve rod member is positioned at the front end position with respect to the valve seat member.

4. The applicator according to claim 1, wherein a pipe passage that communicates the front-side opening to the applying element is arranged at the front-side opening of the valve seat member, and a leading rod element for leading the application liquid toward the applying element is inserted inside the pipe passage.

5. The applicator according to claim 4, wherein a clearance between the leading rod element and an interior wall of the pipe passage is sized so as to lead the application liquid.

6. The applicator according to claim 4, wherein the leading rod element uses a material that presents excellent wettability with the application liquid.

* * * * *